US007222562B2

(12) United States Patent
Smiley

(10) Patent No.: US 7,222,562 B2
(45) Date of Patent: May 29, 2007

(54) ELECTROMAGNETIC VEHICLE COVER

(76) Inventor: Gary LeRoy Smiley, 2360 S. 60 E, Idaho Falls, ID (US) 83406

( * ) Notice: Subject to any disclaimer, the term of this patent is extended or adjusted under 35 U.S.C. 154(b) by 116 days.

(21) Appl. No.: 11/216,706

(22) Filed: Aug. 30, 2005

(65) Prior Publication Data

US 2007/0044646 A1 Mar. 1, 2007

(51) Int. Cl.
*F41H 7/02* (2006.01)

(52) U.S. Cl. ..... 89/36.08; 89/36.02; 296/187.07; 296/136.02

(58) Field of Classification Search ..... 89/36.02, 89/36.08; 296/187.07, 136.02
See application file for complete search history.

(56) References Cited

U.S. PATENT DOCUMENTS

| | | | | |
|---|---|---|---|---|
| 1,913,554 | A | 6/1933 | Luker | |
| 2,363,573 | A | 11/1944 | Costa | |
| 3,147,176 | A | 9/1964 | Haslam | |
| 3,855,898 | A | 12/1974 | McDonald | |
| 4,352,316 | A | 10/1982 | Medlin | |
| 4,810,015 | A * | 3/1989 | McNeil | 293/128 |
| 4,953,442 | A | 9/1990 | Bartuski | |
| 5,312,145 | A | 5/1994 | McNeil | |
| 5,370,035 | A | 12/1994 | Madden, Jr. | |
| 5,531,500 | A | 7/1996 | Podvin | |
| 5,811,719 | A | 9/1998 | Madden, Jr. | |
| 6,027,158 | A | 2/2000 | Yang | |
| 6,041,689 | A | 3/2000 | Lair et al. | |
| 6,161,462 | A | 12/2000 | Michaelson | |
| 6,203,095 | B1 * | 3/2001 | Peterson | 296/136.02 |
| 6,286,895 | B1 * | 9/2001 | Urushiyama et al. | 296/187.03 |
| 6,327,954 | B1 | 12/2001 | Medlin | |
| 6,481,782 | B2 | 11/2002 | Bond | |
| 6,595,575 | B2 * | 7/2003 | Morris | 296/136.02 |
| 6,622,608 | B1 * | 9/2003 | Faul et al. | 89/36.17 |
| 2002/0038962 | A1 * | 4/2002 | Perez | 296/136 |

* cited by examiner

*Primary Examiner*—Stephen M. Johnson

(57) ABSTRACT

A multi-layered protective cover (10) for the exterior of a vehicle, held in place over the hood by means of a main strap (12), a main strap lock (14), and an underside lock (16). Rounded pad (20) forms a frame along the perimeter of a vehicle. For easy entry or exit, latch on rounded pad (22), Velcro.RTM cover (24), zipper (26), and fasteners (28) are provided. Along an upper frame (34), insulated wire (36) is connected from panel to panel by an electrical plug (30), and an electrical socket (32). Electromagnets, consisting of an iron bar (38) and an iron head (40) are inlaid in a rubber layer (42). A lower frame (44) provides support for a bullet-proof layer (46) and a water-proof layer (48). When current flows to the electromagnets, the cover is affixed to a body of vehicle (50).

1 Claim, 9 Drawing Sheets

ELECTROMAGNETIC VEHICLE COVER

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF INVENTION —FIELD OF INVENTION

This invention protects the exterior of a vehicle from projectiles and is affixed by electromagnets.

BACKGROUND OF INVENTION—PRIOR ART

The retrofitting of vehicles with armor to protect the exterior of the vehicle or passengers has been described in the prior art. U.S. Pat. No. 1,913,554 to Luker (1933) is one such example, in which armor plating is affixed to the front of a vehicle. U.S. Pat. No. 2,363,573 to Costa (1944) discloses an armored shell, albeit to install the armored shell entails that all parts not essential to the operation of the vehicle need to be removed. U.S. Pat. No. 4,352,316 to Medlin (1982) discloses a lightweight armored vehicle and method of making same using woven polyester glass protective sheets. In Medlin (1982), the interior furnishings must be stripped, doors, and windows rebuilt in order to mount a bullet-proof, transparent window. U.S. Pat. No. 6,327,954 to Medlin (2001) discloses prefabricated, lightweight composite armor that protects the interior cab of a vehicle, but not the rest of the vehicle, e.g. hood, side panels, and trunk. U.S. Pat. No. 5,370,035 to Madden, Jr. (1994) discloses a bullet-proof apparatus for the back side of a front seat. Another bullet-proof assembly, this time for the interior side of a door panel, is disclosed by U.S. Pat. No. 6,027,158 to Yang (2000). Another example of retrofitting of the interior with armor is U.S. Pat. No. 6,041,689 to Lair et al (2000).

U.S. Pat. No. 3,855,898 to McDonald (1974) discloses a transparent, bullet-proof plastic panel fastened by metal clips or fabric straps to the windshield and windows. McDonald (1974) also discusses a protective panel that can be attached to the inside of a side door or other parts of the vehicle.

In the prior art, examples of removable armor include U.S. Pat. No. 5,811,719 to Madden, Jr. (1998). Madden, Jr. (1998) discloses a flexible, bullet-proof curtain that secures to the interior side of a door. U.S. Pat. No. 5,531,500 to Podvin (1996) discloses a bullet-proof panel affixed to the exterior surface of a door, in which the shape conforms to the contour of the sheet metal. To fasten a protective layer to the vehicle, magnets have been employed in several instances in the prior art. For example, U.S. Pat. No. 3,147,176 to Haslam (1964) is a magnetic protector strip for a car door. U.S. Pat. No. 4,810,015 to McNeil (1989) and U.S. Pat. No. 5,312,145 to McNeil (1994) disclose a motor vehicle body protection apparatus which covers part of the exterior of door, and is affixed by magnets. However, McNeil's disclosure is only meant to cover a strip of the door, enough to protect the door from another vehicle's door, as commonly encountered in the context of a parking lot. U.S. Pat. No. 6,161,462 to Michaelson (2000) discloses a bullet-proof blanket, affixed by magnets, for use with law enforcement vehicles such as police vehicles. Conceived to be first installed when the officer happens upon a shootout, Michaelson's (2000) disclosure is therefore intended for stationary use only, that is, for the duration of the shootout.

U.S. Pat. No. 6,481,782 B2 to Bond (2002) discloses a small, light-weight, bullet-proof shield affixed on the side of a vehicle door, including a magnetic backing covered by a bullet-proof mesh material. U.S. Pat. No. 4,953,442 to Bartuski (1990) discloses a magnetized ferrous ceramic material encapsulated in a fiberglass layer.

A great deal of income is spent on the purchase of vehicles. While many of the vehicles produced have the capability to be used off-road, most are only used in an urban context. Excessive body damage such as scratches or dents from off-road use entail high repair costs. Not only are the repair costs expensive but the re-sale value of the vehicle decreases. The present invention, therefore, is primarily intended to protect the side panels of a vehicle when used both on-road or off-road. By use of a lightweight yet bullet-proof strength, protective polymeric material, potential damage to the exterior of a vehicle by sunlight, branches, projected rocks or other obstacles may be reduced.

With minor modifications, the present invention may be used in civilian, police, or military use. In police or military use, the cost of the protective cover is intended to be well below the cost entailed in the process of retrofitting armor to a vehicle. According to the shape of the vehicle, the electromagnetic protective cover may be tailored for an exact fit. Or, the protective cover may also be tailored to fit over a frame (e.g. a soft top) to cover passengers sitting in the back of a truck, or completely cover a vehicle such as a sport utility vehicle. The present invention, moreover, may be removed after the life span of a vehicle has expired and affixed to another vehicle.

A main novelty of the device is the use of electromagnetism. Electromagnetism ensures a close fit of the protective cover to the exterior of a vehicle. As long as current runs to the electromagnets, they are strongly affixed to the exterior of the vehicle.

BACKGROUND OF INVENTION—OBJECTS AND ADVANTAGES

A main object of the protective cover is to decrease or eliminate vehicular body damage as a consequence of regular on-road or off-road use regardless of road conditions and weather.

It is an object to tightly affix the protective cover to the body of the vehicle by way of electromagnetism. By sending current through insulated wire, which is wound around temporary magnets, a magnetic field is created around each soft iron bar.

It is an object to use the protective cover in either civilian, police, or military applications with modification according to the purpose. In the case of passengers occupying the back of the military truck, the protective cover may be expanded to fit over a roll-cage.

Another object is that the protective cover can be folded when not in use, placed in a suitcase, and stored in the trunk. Prior to off-road use, the protective cover can be quickly placed over the body of the vehicle.

It is an object that the external layer is made of a protective, water-proof material such as polypropylene in order to protect the electromagnets and insulated wires. After off-road use, the protective cover may be cleaned with water.

Another object is that an inner layer of the protective cover includes a bullet-proof material.

In order to deter theft when current does not flow to the temporary magnets, an object is to include a main strap and main strap lock. As deemed necessary, more straps and locks may be added to the design.

To ensure quick entry and exit from the vehicle, even when the protective cover is in place, an object is to include quick releasing latches located at the top of the doors. Once the latches are closed, a covering made of Velcro.RTM is pulled over the perforation and latches. The latches can be locked.

Another object is that a rounded pad, potentially made of rubber or plastic, protects the corners of the vehicle from contact with obstacles. Attached to the bottom of the rounded pad, an upper frame houses the insulated wire between a panel to an adjacent panel.

Another object is that an electrical plug on a panel and socket on an adjacent panel are located at the ends of the upper frame. When the plug and socket are connected, electrical current flows to each electromagnet.

A final object is to include permanent magnets to hold the protective cover in place during mounting or when current does not flow to the electromagnets.

SUMMARY

Affixed by electromagnets to the body of a vehicle, the cover affords bullet-proof protection to the vehicle during on-road and off-road use.

DRAWINGS—FIGURES

The annexed drawings supplement the text in order to give a comprehensive description of the protective cover.

DRAWINGS—REFERENCE NUMERALS

Figure 1:
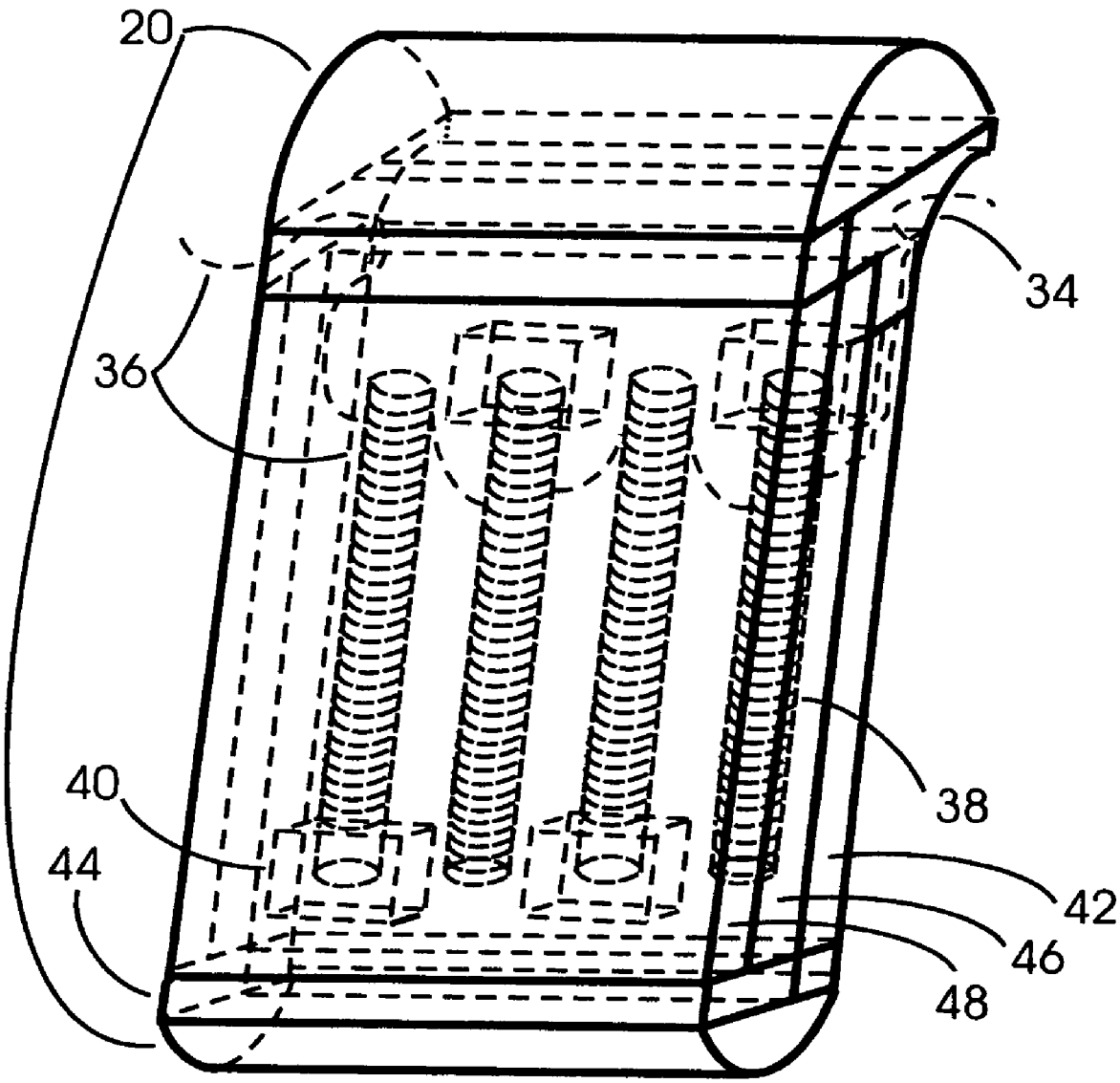
FIG. 1 is a perspective view of one panel of the protective cover.

10 protective cover
12 main strap
14 main strap lock
16 underside lock
20 rounded pad
22 latch on rounded pad
24 Velcro.RTM cover
26 zipper
28 fasteners
30 electrical plug
32 electrical socket
34 upper frame
36 insulated wire
38 iron bar
40 iron head
42 rubber layer with inlaid pattern
44 lower frame
46 bullet-proof layer
48 water-proof layer
50 body of vehicle

DESCRIPTION OF THE PREFERRED EMBODIMENT

To better understand the preferred embodiment, the following description of figures is useful.

1. Detailed Description of the Figures

FIG. 1 is a perspective view of an individual panel of the protective cover, showing all layers involved. Rounded pad 20 is indicated at the top and bottom of the protective cover. Below and attached to rounded pad 20 is upper frame 34. Insulated wire 36 enters and exits each panel of the protective cover through upper frame 34. The parallel configuration of soft iron bars 38 is shown in FIG. 1 with the positive side (iron head 40) next to an adjacent electromagnet and its negative side (iron bar 38). The soft iron bars (plus iron heads) are housed within a rubber panel 42. According to the shape of soft iron bar 38 and head 40, a pattern is cut-out in the rubber panel with inlaid pattern 42. By housing the electromagnets in a rubber panel, movement of electromagnets is restricted. With current, insulated wire 36, tightly wound around each soft iron bar, creates a magnetic field around each soft iron bar 38. Iron head 40 becomes the side of the electromagnet with attraction to the steel body of a vehicle. Also depicted in FIG. 1 is a bullet-proof layer 46 over the electromagnets. Finally, over the protective panel, a water-proof layer 48 is seen. At the bottom of the protective cover, lower frame 44 provides support.

Figure 2:
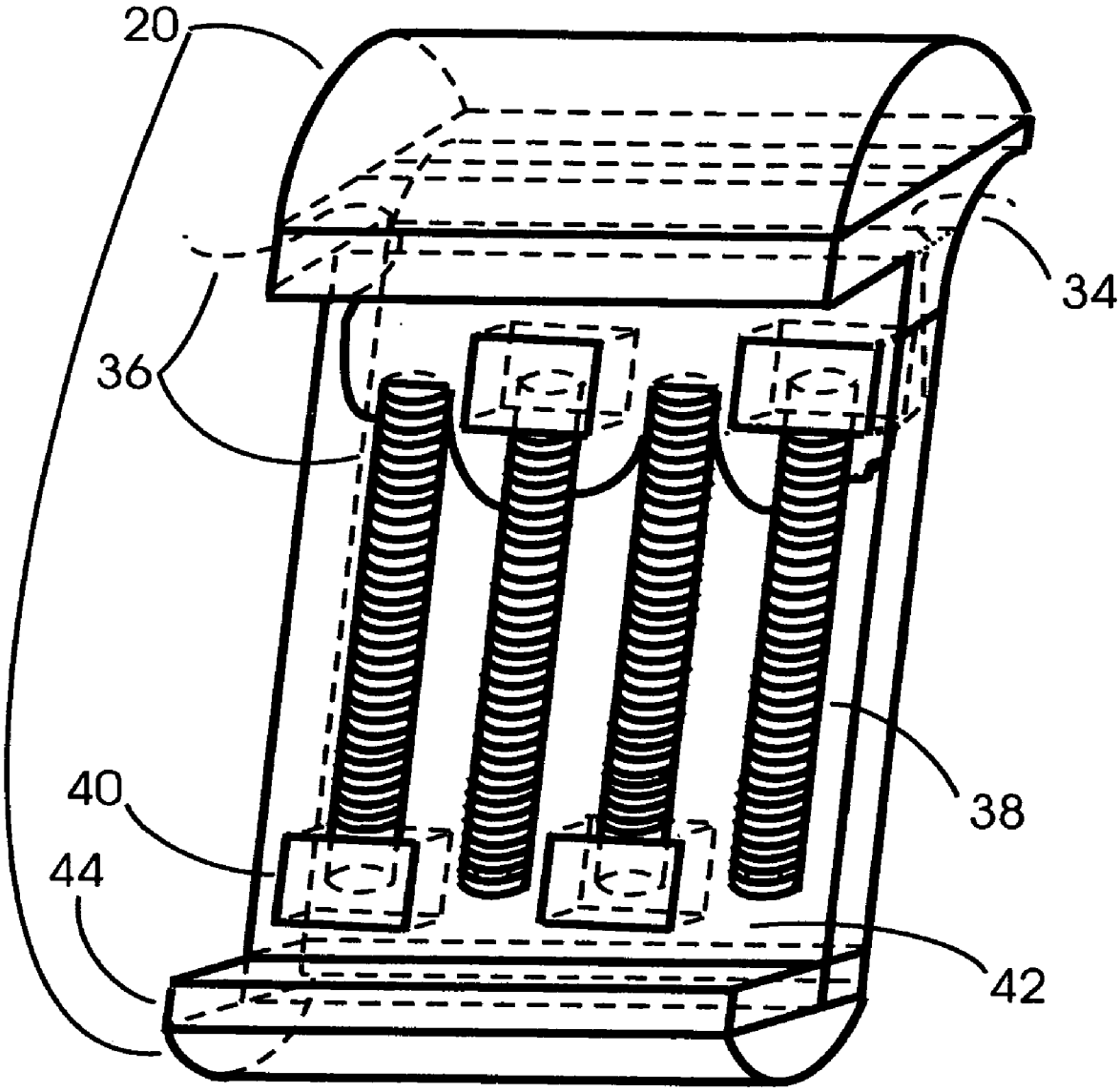
FIG. 2 is a perspective view of one panel of the protective cover, minus the bullet-proof layer and water-proof layer.

FIG. 2 is a perspective view of an individual panel of the protective cover as in FIG. 1 but minus the outer two layers (bullet-proof layer 46 and water-proof layer 48).

Figure 3:
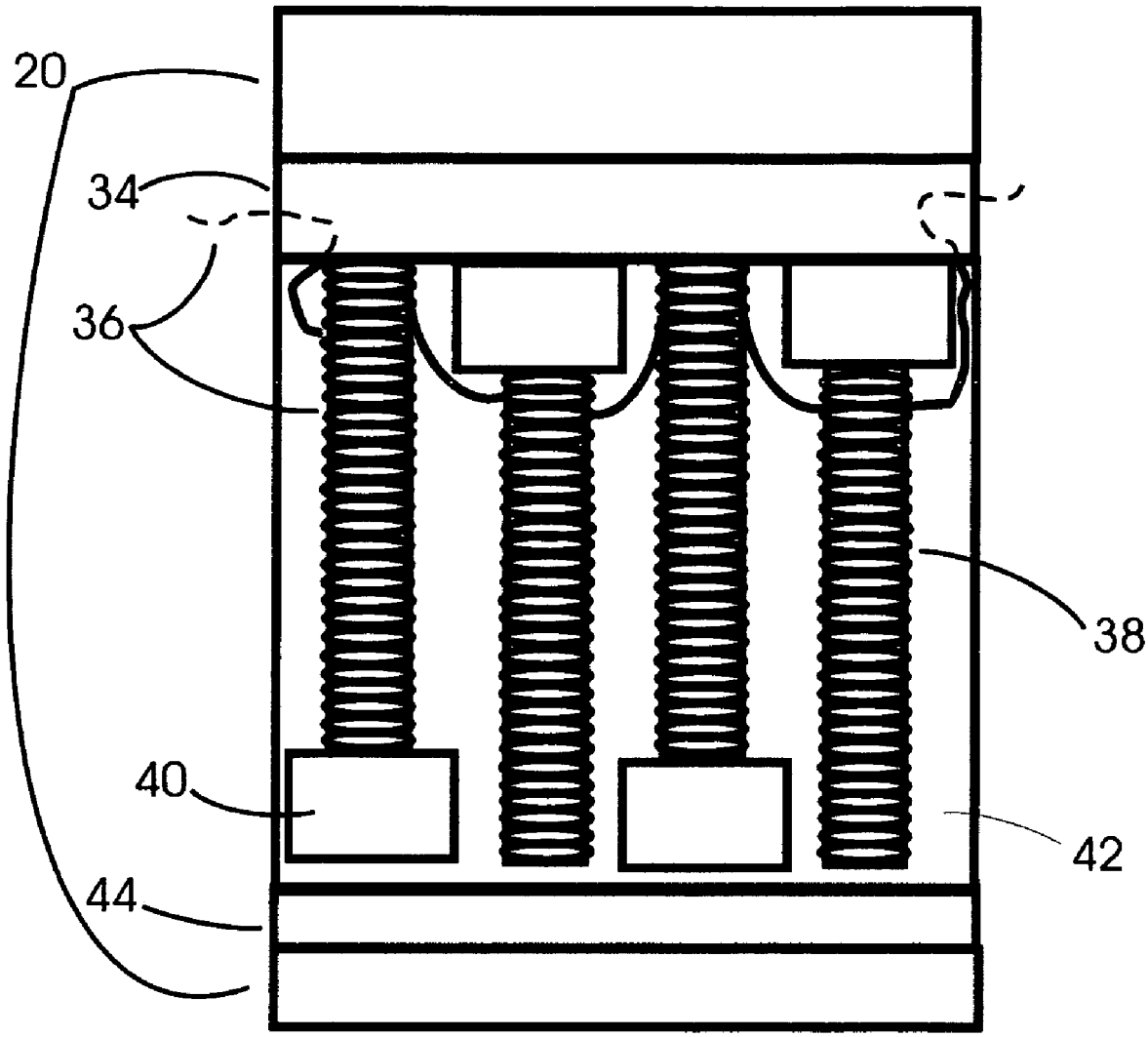
FIG. 3 is a front view of one panel of the protective cover.

FIG. 3 is a front view of an individual panel of the protective cover. In FIG. 3, rounded pad 20 is connected to upper frame 34. Through upper frame 34, insulated wire 36 connects from panel to adjacent panel. In the rubber panel with inlaid pattern 42, electromagnets consisting of iron bar 38 and iron head 40 are shown. At the bottom of the panel and attached to rounded pad 20 is lower frame 44.

Figure 4:
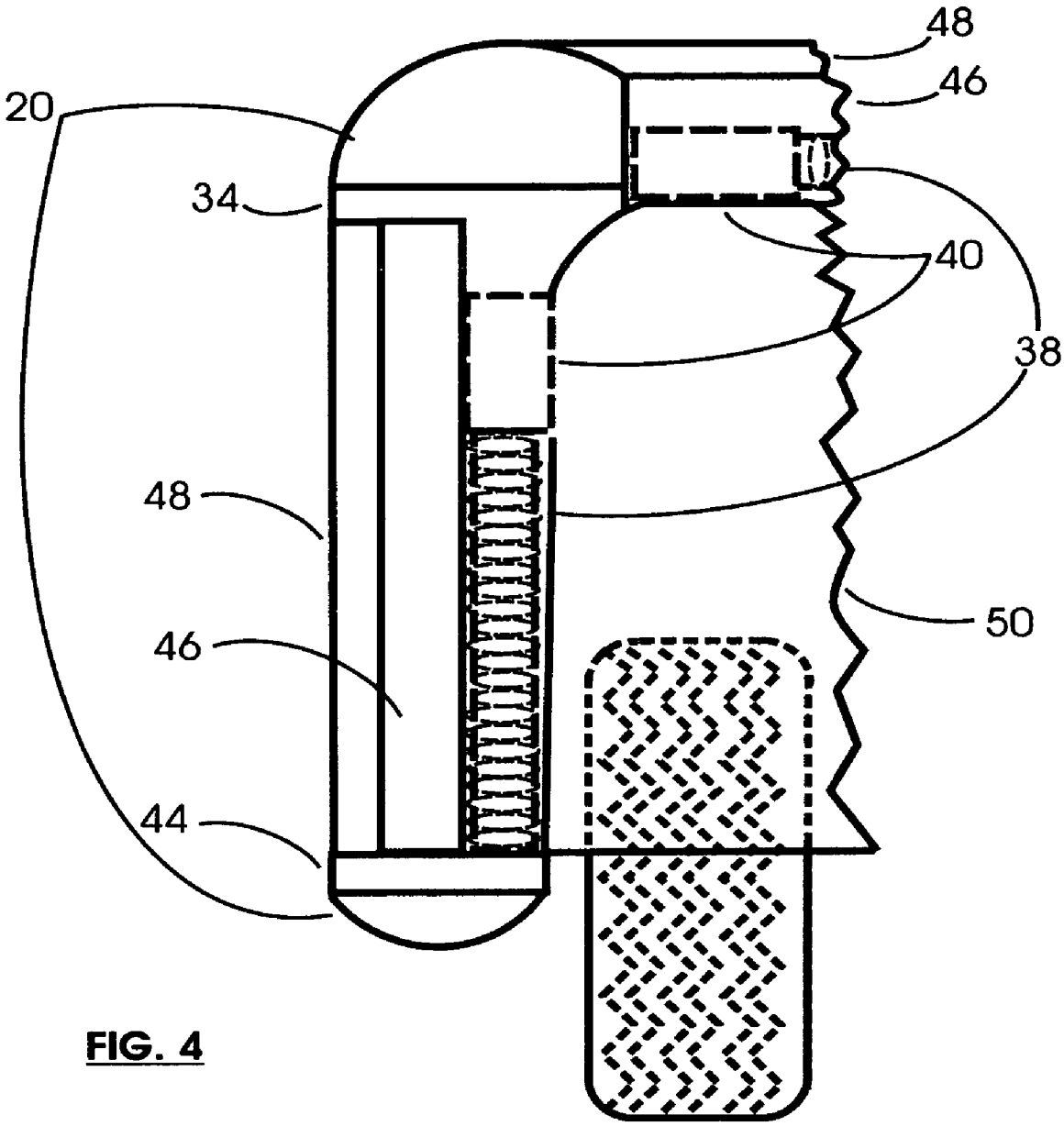
FIG. 4 is a cross-sectional view of one panel of the protective cover, attached to the exterior of a vehicle.

FIG. 4 is a cross-sectional view of an individual panel of the protective cover, as attached directly with iron head 40 to body of vehicle 50. The upper frame 34 connects to rounded pad 20, upper part of the electromagnet or iron head 40, bullet-proof layer 46, and water-proof layer 48. At the bottom of the protective cover is lower frame 44, connected to rounded pad 20.

Figure 5:
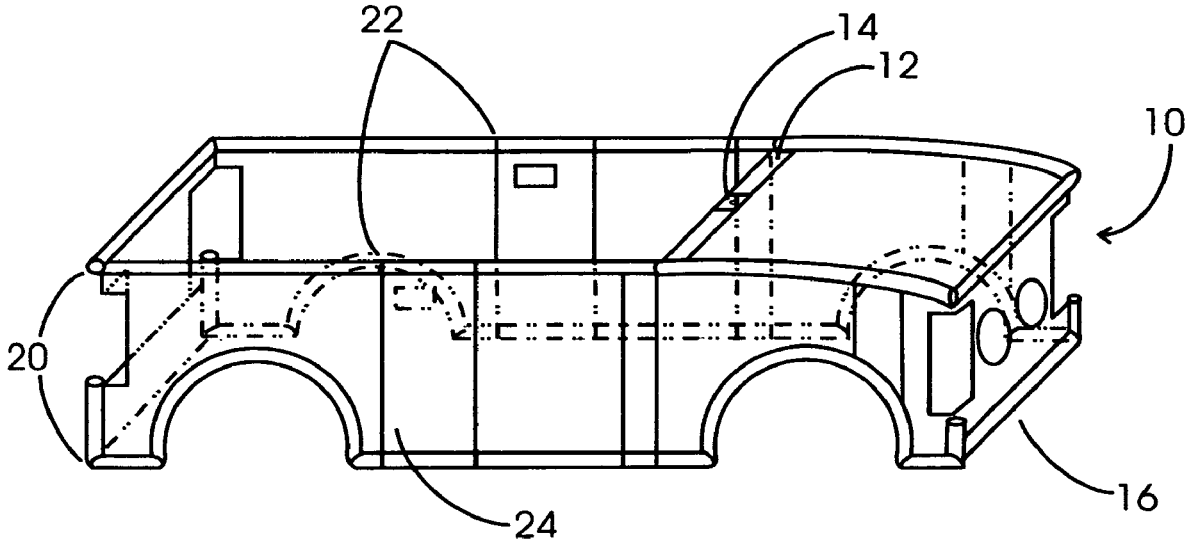
FIG. 5 is a perspective view of the protective cover with perforations closed.

In FIG. 5, protective cover 10 is shown in a perspective view, unattached to a vehicle. All perforations are closed, including main strap 12, main strap lock 14, and underside lock 16. Forming a frame on the top and bottom of protective cover 10 is rounded pad 20, and latch on rounded pad 22.

Figure 6:
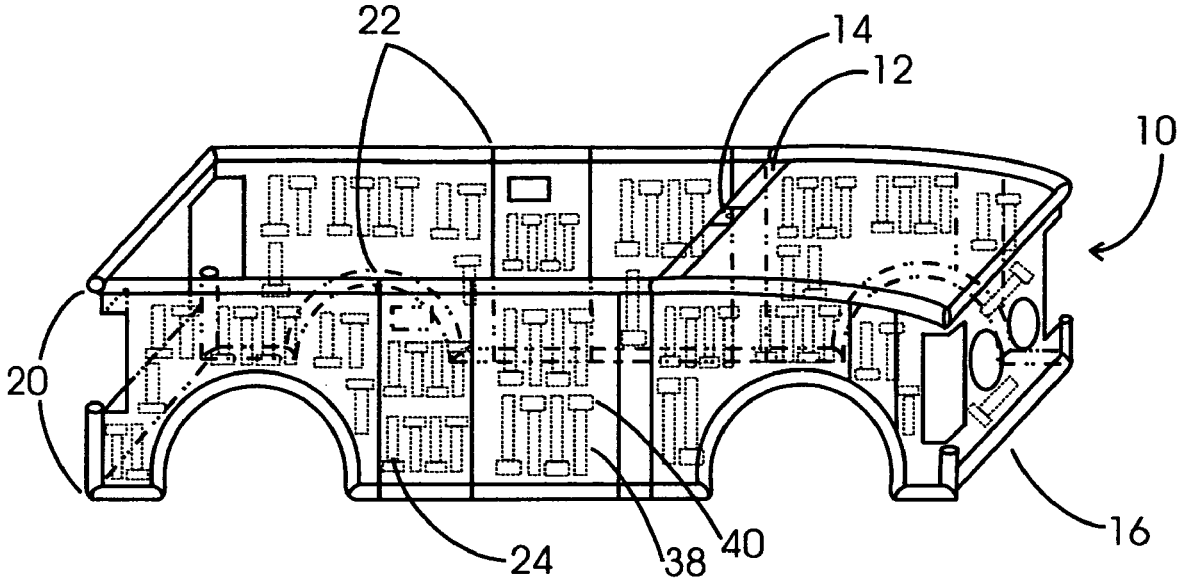
FIG. 6 is a perspective view of the protective cover with perforations closed, showing the general locations of the electromagnets.

In FIG. 6, protective cover 10 is shown in a perspective view as in FIG. 5 with the addition of electromagnets, indicated by iron bar 38 and iron head 40. All perforations are closed. All components are shown as in FIG. 5, including main strap 12, main strap lock 14, underside lock 16, rounded pad 20, and latch on rounded pad 22.

Figure 7:
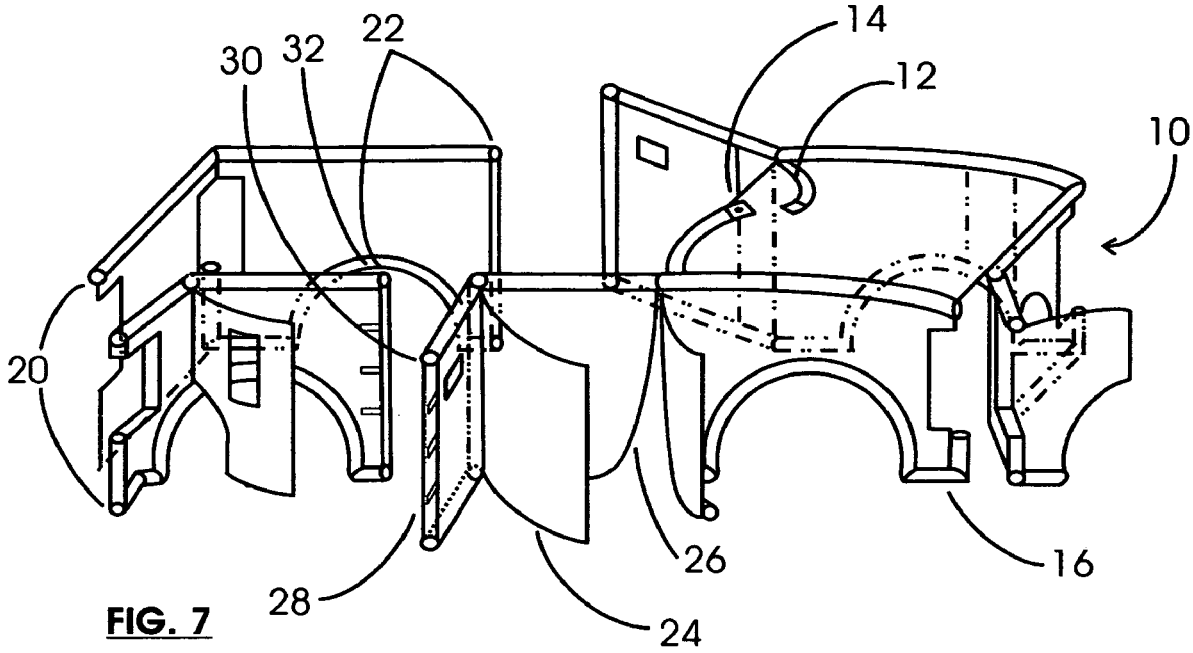
FIG. 7 is a perspective view of the protective cover with perforations open.

In FIG. 7, protective cover 10 is shown in a perspective view but the perforations are opened, symbolizing attaching or detaching the protective cover. Main strap 12 and main strap lock 14 are unfastened. Below the vehicle, the location of underside lock 16 is indicated. Rounded pad 20 opens at the door, as well as at the front and rear of the vehicle. The Velcro.RTM cover 24 is opened at the door, as well as at the front and rear of the vehicle. Along the perforations at the hinge side of the door is zipper 26. Along the perforations at the doors, fasteners 28 are shown and meant for quick release and reattachment. Electrical plug 30 and electrical socket 32 are indicated in FIG. 7.

Figure 8:
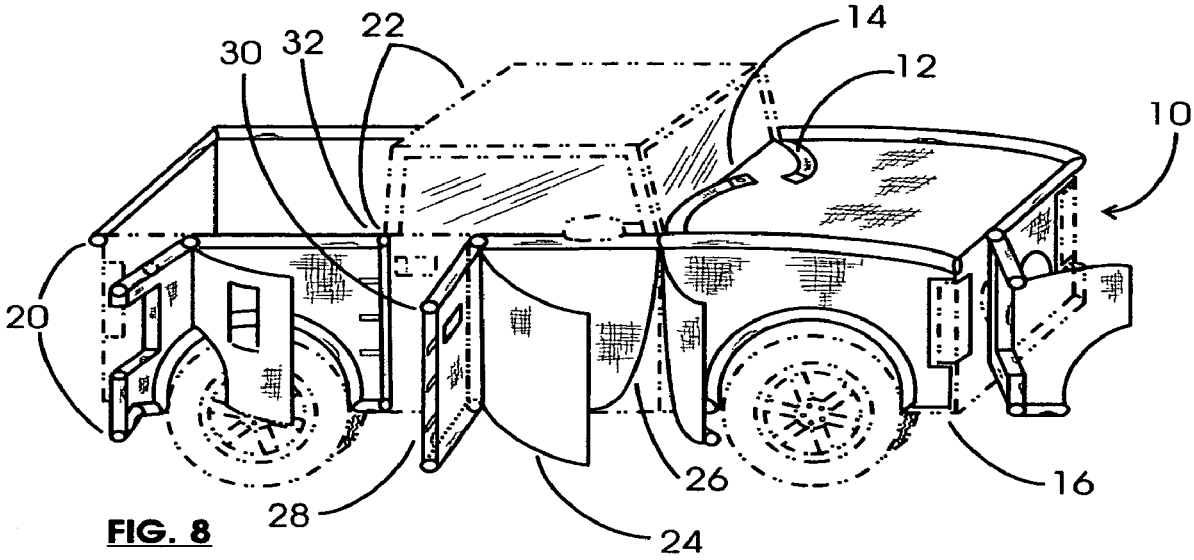
FIG. 8 is a perspective view of the protective cover with perforations opened, attached to the exterior of a vehicle.

In FIG. 8, protective cover 10 is shown in a perspective view as attached to the exterior of a vehicle, but all perforations are opened. Main strap 12 and main strap lock 14 are opened. Underside lock 16, located under the front bumper, is opened. At the door opening, on the end of rounded pad 20, latch on rounded pad 22 is opened. The Velcro.RTM cover 24 is also opened.

Figure 9:
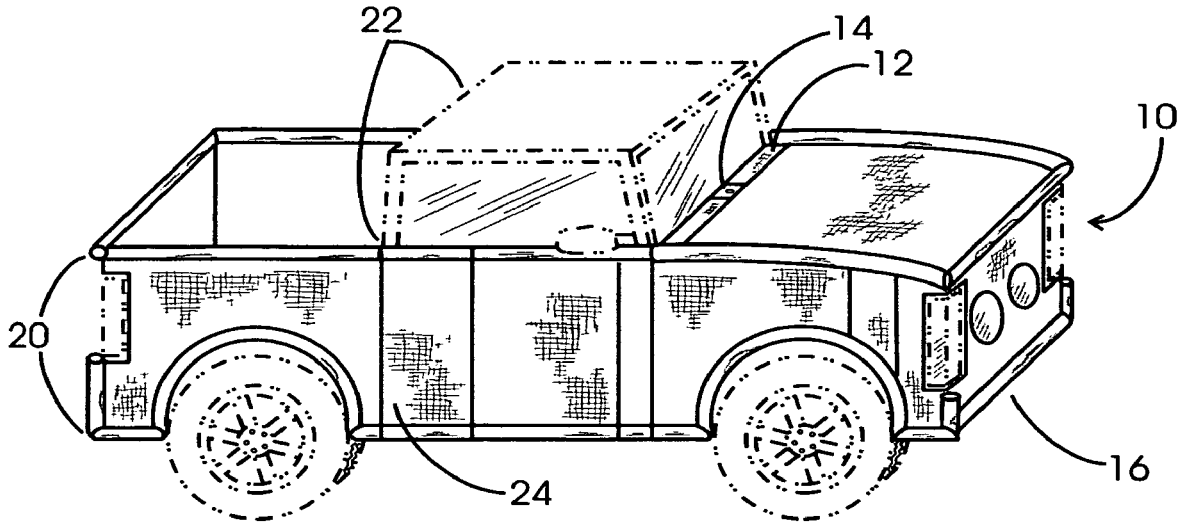
FIG. 9 is a perspective view of the protective cover with perforations closed, attached to the exterior of a vehicle.

In FIG. 9, protective cover 10 is shown in a perspective view as attached to the exterior of a vehicle as in FIG. 8, but all perforations are closed. Main strap 12 and main strap lock 14 are closed. Underside lock 16, located under the front bumper, is closed. At the door opening, latch on rounded pad 22 is closed, and rounded pad 20 forms a frames along the perimeter of the vehicle. The Velcro.RTM cover 24 is also closed.

I claim:

1. A multi-layered, protective electromagnetic cover for a vehicle, comprising:

(a) a series of electromagnets used to affix a protective cover to a vehicle's body, and (b) said electromagnets connected from panel to panel by insulated wiring, sockets, and plugs of the protective cover and (c) a frame of said protective electromagnetic cover consisting of a rounded pad, wiring, and layers necessary for providing bullet-proof and water-proof capability of the protective cover.

* * * * *